US007503810B1

(12) United States Patent
Goodrich et al.

(10) Patent No.: US 7,503,810 B1
(45) Date of Patent: Mar. 17, 2009

(54) BOARD EDGE TERMINATION BACK-END CONNECTION ASSEMBLIES AND COMMUNICATIONS JACKS INCLUDING SUCH ASSEMBLIES

(75) Inventors: Robert Ray Goodrich, Indianapolis, IN (US); Michael Walter Canning, Plano, TX (US); Amid I. Hashim, Plano, TX (US)

(73) Assignee: CommScope, Inc. of North Carolina, Hickory, NC (US)

( * ) Notice: Subject to any disclaimer, the term of this patent is extended or adjusted under 35 U.S.C. 154(b) by 0 days.

(21) Appl. No.: 11/854,063

(22) Filed: Sep. 12, 2007

(51) Int. Cl.
*H01R 24/00* (2006.01)

(52) U.S. Cl. ..... 439/676; 439/941

(58) Field of Classification Search ..... 439/676, 439/941

See application file for complete search history.

(56) References Cited

U.S. PATENT DOCUMENTS

| | | | | |
|---|---|---|---|---|
| 4,725,249 | A | 2/1988 | Blackwood et al. | |
| 6,196,880 | B1 | 3/2001 | Goodrich et al. | |
| 6,267,617 | B1 | 7/2001 | Nozick | |
| 6,358,093 | B1 * | 3/2002 | Phommachanh et al. | 439/620.23 |
| 6,488,525 | B2 | 12/2002 | Abel et al. | |
| 6,565,375 | B1 | 5/2003 | Daoud et al. | |
| 6,592,396 | B2 | 7/2003 | Pepe et al. | |
| 6,746,283 | B2 | 6/2004 | Arnett et al. | |
| 6,752,647 | B1 | 6/2004 | Lin | |
| 6,767,241 | B1 | 7/2004 | Abel et al. | |
| 6,953,362 | B2 | 10/2005 | Mössner et al. | |
| 7,025,621 | B2 | 4/2006 | Mössner et al. | |
| 7,052,307 | B2 * | 5/2006 | Kim et al. | 439/404 |
| 2005/0106946 | A1 | 5/2005 | Doorhy et al. | |
| 2006/0154531 | A1 | 7/2006 | Kim et al. | |

FOREIGN PATENT DOCUMENTS

| | | | |
|---|---|---|---|
| GB | 2343558 | A | 5/2000 |
| WO | 2005/064755 | A1 | 7/2005 |

OTHER PUBLICATIONS

Pictures of AMO Category 6 ACO System Outlets (Admitted Prior Art).
AMP Category 6 ACO Inserts and Installation Kits Spec sheet (Admitted Prior Art).
AMP Communications Outlet (ACO System Plus Spec Sheets (http://nordics.ampnetconnect.com/acoplus.asp) (Admitted Prior Art.
International Search Report and Written Opinion for PCT/US2008/010647, mailed Nov. 13, 2008.

* cited by examiner

*Primary Examiner*—Tho D Ta
(74) *Attorney, Agent, or Firm*—Myers Bigel Sibley & Sajovec

(57) ABSTRACT

A communications jack includes a housing having a plug aperture, a printed circuit board that is disposed at least partly within the housing, and eight jackwire contacts that are mounted on the printed circuit board and extend into the plug aperture. A first side of the printed circuit board further includes four output contacts and an opposed second side of the printed circuit board further includes another four output contacts. A board edge termination assembly is mounted on an edge of the printed circuit board. The board edge termination assembly includes a body and eight contact members that are disposed at least partly within the body. Each contact member is configured to mate with a respective one of the output contacts.

22 Claims, 12 Drawing Sheets

BOARD EDGE TERMINATION BACK-END CONNECTION ASSEMBLIES AND COMMUNICATIONS JACKS INCLUDING SUCH ASSEMBLIES

FIELD OF THE INVENTION

The present invention relates generally to communications connectors and, more particularly, to back-end connection assemblies for communications jacks.

BACKGROUND

Computers, fax machines, printers and numerous other electronic devices are routinely connected by communications cables to network equipment and/or to external networks such as the Internet. FIG. 1 illustrates the manner in which a computer 10 may be connected to network equipment 20 using conventional communications plug/jack connections. As shown in FIG. 1, the computer 10 is connected by a patch cord assembly 11 to a communications jack 30 that is mounted in a wall plate 19. The patch cord assembly 11 comprises a cable 12 that contains a plurality of individual conductors and two communications plugs 13, 14. The communications plug 13 is attached to a first end of the cable 12, and the communications plug 14 is attached to the other end of the cable 12. The communications plug 13 is inserted into a communications jack (not pictured in FIG. 1) that is provided in the back of the computer 20, and the communications plug 14 inserts into a plug aperture 32 in the front side of the communications jack 30. The blades of communications plug 14 (which are exposed through the slots 15 on the top surface of communications plug 14) mate with respective contacts 41-48 (see FIG. 2) of the communications jack 30 when the communications plug 14 is inserted into the plug aperture 32. The blades of communications plug 13 similarly mate with respective contacts of the communications jack (not pictured in FIG. 1) that is provided in the back of the computer 10.

The communications jack 30 includes a back-end connection assembly 50 that receives and holds conductors from a cable 60. As shown in FIG. 1, each conductor of cable 60 is individually pressed into a respective one of a plurality of slots provided in the back-end connection assembly 50 to establish mechanical and electrical connection between each conductor of cable 60 and the communications jack 30. The other end of each conductor in cable 60 may be connected to, for example, the network equipment 20. The wall plate 19 is typically mounted on a wall (not shown) of a room or office of, for example, an office building, and the cable 60 typically runs through conduits in the walls and/or ceilings of the building to a computer room in which the network equipment 20 is located. The patch cord assembly 11, the communications jack 30 and the cable 60 provide a plurality of signal transmission paths over which information signals may be communicated between the computer 10 to the network equipment 20.

In most electrical communications systems that are used to interconnect computers, network equipment, fax machines, printers and the like, the information signals are transmitted between devices over a pair of conductors (hereinafter a "differential pair" or simply a "pair") rather than over a single conductor. The signals transmitted on each conductor of the differential pair have equal magnitudes, but opposite phases, and the information signal is embedded as the voltage difference between the signals carried on the two conductors of the pair. When signals are transmitted over a conductor (e.g., an insulated copper wire) in a communications cable, electrical noise from external sources such as lightning, computer equipment, radio stations, etc. may be picked up by the conductor, degrading the quality of the signal carried by the conductor. When the signal is transmitted over a differential pair of conductors, each conductor in the differential pair often picks up approximately the same amount of noise from these external sources. Because approximately an equal amount of noise is added to the signals carried by both conductors of the differential pair, the information signal is typically not disturbed, as the information signal is extracted by taking the difference of the signals carried on the two conductors of the differential pair; thus the noise signal is cancelled out by the subtraction process.

Currently, high speed communications systems that are used to connect computers and/or other processing devices to local area networks and/or to external networks such as the Internet typically include four differential pairs per communications cable. In such systems, the conductors of the multiple differential pairs are usually bundled together within a single, jacketed cable, and thus necessarily extend in the same direction for some distance. Unfortunately, when multiple differential pairs are bunched closely together, another type of noise referred to as "crosstalk" may arise, which refers to signal energy from a conductor of one differential pair that is picked up by a conductor of another differential pair in the communications system. The induced crosstalk may include both near-end crosstalk (NEXT), which is the crosstalk measured at an input location corresponding to a source at the same location, and far-end crosstalk (FEXT), which is the crosstalk measured at the output location corresponding to a source at the input location. Both types of crosstalk comprise an undesirable noise signal that interferes with the information signal.

FIG. 2 is an exploded perspective view of the communications jack 30 of FIG. 1. As shown in FIG. 2, the communications jack 30 includes a three-piece housing 35, 36, 37. Housing piece 35 defines (at least partly) a plug aperture 32 that is configured to receive a mating communications plug. Housing pieces 36, 37 partially cover and protect a printed circuit board 34. A plurality of jackwire contacts 41-48 are mounted on the printed circuit board 34 so as to extend into the plug aperture 32 from the back of the communications jack 30. However, it will be appreciated that, in other embodiments, some or all of the jackwire contacts 41-48 may extend into the plug aperture 32 from a different direction such as, for example, from the front of the communications jack 30. Each of the jackwire contacts 41-48 terminates into the printed circuit board 34.

The jack 30 further includes a plurality of insulation displacement contacts ("IDCs") 51-58 that are mounted on the printed circuit board 34. As is well known to those of skill in the art, an IDC is a type of wire connection terminal that may be used to make mechanical and electrical connection to an insulated wire conductor. In the communications jack 30, a plurality of electrically conductive paths (not shown in FIG. 2) are provided on the printed circuit board 34. Typically, each of these electrical conductive paths will comprises one or more traces that are disposed on one or more layers of the printed circuit board 34. If the traces of one of the electrically conductive paths are disposed on multiple layers of the printed circuit board 34, the traces on different layers may be interconnected by conductive vias. Each of the electrically conductive paths may provide an electrical path between a respective one of the jackwire contacts 41-48 and a corresponding one of the IDCs 51-58. Housing piece 36 includes a plurality of pillars that define slots which receive the IDCs 51-58. Each slot defined by the pillars is configured to receive a conductor of a communications cable so that the conductor may be inserted into a slot in a respective one of the IDCs 51-58.

FIG. 3 is a perspective view of the communications jack 30 of FIGS. 1-2 with the communications cable 60 terminated thereto. As shown in FIG. 3, the communications cable 60 includes either insulated conductors 61-68 which are arranged as four differential pairs 71-74. The individual conductors that comprise each differential pair 71-74 are twisted about each other, and all four differential pairs 71-74 are twisted about each other in what is known in the art as a "core twist" (not visible in FIG. 3). The communications cable 60 may also include a separator 69 that separates at least some of the differential pairs 71-74 from other of the differential pairs 71-74, as well as a jacket 70 that encloses and protects the conductors 61-68.

As is also shown in FIG. 3, each of the conductors 61-68 is terminated onto a respective one of the IDCs 51-58. As illustrated in FIG. 2, each IDC 51-58 includes a pair of opposed upwardly extending arms. As shown in FIG. 3, each conductor 61-68 is inserted into the gap between the opposed arms of its corresponding IDC 51-58. The inner edges of the opposed arms cut the insulation on the conductor such that both a mechanical connection and an electrical connection are established between the each conductor 61-68 and its corresponding IDC 51-58. Typically, a technician terminates each conductor 61-68 of cable 60 into the IDCs 51-58 of communications jack 30 by hand at the time that the communications jack 30 is installed in the faceplate 19.

SUMMARY

Pursuant to embodiments of the present invention, communications jacks are provided that include a housing having a plug aperture and a printed circuit board having first and second opposed sides that may be disposed at least partly within the housing. The first side of the printed circuit board includes first through fourth output contacts and the second side of the printed circuit board includes fifth through eighth output contacts. Additionally, first through eighth input contacts are mounted on the printed circuit board so as to extend into the plug aperture. The jack further includes a board edge termination assembly that is mounted on an edge of the printed circuit board opposite the plug aperture end. The board edge termination assembly has a body and first through eighth contact members that are disposed at least partly within the body. Each of the first through eighth contact member is configured to mate with a respective one of the output contacts.

In some embodiments, each of the plurality of input contacts may be a jackwire contact, each of the plurality of output contacts may be a contact pad, and each of the contact members has a wire connection terminal portion and a spring contact portion. In these embodiments, the spring contact portion of each of the contact members may be configured to mate with a respective one of the contact pads.

In some embodiments, the body of the board edge termination assembly includes an aperture that is configured to receive a jacketed communications cable that includes a plurality of differential pairs of conductors. The body may have a cable receiving end that includes the aperture and a board mounting end that includes first and second shelves that at least partially define an opening therebetween that receives the edge of the printed circuit board. An interior surface of each of the first and second shelves may include a plurality of slots, and the spring contact portion of a respective one of the contact members may extend through each of the plurality of slots.

The body of the board edge termination assembly may further include a plurality of recesses, and one of the contact members may be mounted in each recess. A plurality of twist terminators may be provided. Each twist terminator may be positioned in a respective one of the plurality of recesses. The body may also include a plurality of passages, each of which extending between the aperture and a respective one of the recesses.

In some embodiments, the board edge termination assembly includes first and second pivotable caps. The first pivotable cap may be connected to the body by a first hinge and the second pivotable cap may be connected to the body by a second hinge. The board edge termination assembly may be releasably attached to at least one of the housing or the printed circuit board.

Pursuant to further embodiments of the present invention, communications jacks are provided that include a printed circuit board and a housing having a plug aperture. A plurality of contact pads and a plurality of jackwire contacts are mounted on the printed circuit board. The jacks further include a board edge termination assembly that is mounted on an edge of the printed circuit board. The board edge termination assembly includes a body and a plurality of contact members that may be disposed at least partly within the body. Each of the contact members includes a wire connection terminal portion and a spring contact portion that is configured to mate with a respective one of the contact pads. Moreover, the board edge termination assembly further includes a cable receiving aperture that is configured to receive a jacketed communications cable that includes a plurality of differential pairs of conductors. In some embodiments, the body may include a cable receiving end that includes the aperture and a board mounting end that includes first and second shelves that at least partially define an opening therebetween that receives the edge of the printed circuit board.

In some embodiments of these jacks, some of the plurality of contact pads are located on an upper surface of the printed circuit board, and others of the plurality of contact pads are located on a lower surface of the printed circuit board. The board edge termination assembly may, in some embodiments, include a first pivotable cap and a second pivotable cap, wherein the first pivotable cap is connected to the body by a first hinge and the second pivotable cap is connected to the body by a second hinge. An interior surface of each of the first and second shelves may include a plurality of slots, and the spring contact portion of a respective one of the contact members may extend through each of the plurality of slots.

Pursuant to still further embodiments of the present invention, board edge termination assemblies are provided that are configured to mate with a communications jack that includes a printed circuit board having a plurality of contact pads thereon. These board edge termination assemblies include a body that has an aperture that is configured to receive a communications cable that includes a plurality of differential pairs of conductors and a plurality of contact members disposed at least partly within the body. The body includes first and second shelves that at least partially define an opening therebetween. This opening is configured to receive an edge of the printed circuit board of the communications jack. Some of the contact members are mounted in the first shelf and other of the contact members are mounted in the second shelf. Each of the contact members includes a wire connection terminal portion that is configured to connect with a respective one of the conductors of the communications cable and a spring contact portion that is configured to make electrical contact with a respective one of the contact pads on the printed circuit board.

In some embodiments, the spring contact portions of the contact members extend through respective slots in either the first shelf or the second shelf. The board edge termination assembly may also include first and second pivotable caps that are connected to the body by respective first and second hinges. The board edge termination assembly may also include at least one latch that is configured to releasably attach the board edge termination assembly to the communications jack.

Pursuant to further embodiments of the present invention, methods of terminating a communications cable that includes a plurality of differential pairs of conductors to a communications jack are provided. Pursuant to these methods, each of the conductors of the plurality of differential pairs of conductors are terminated into a respective contact member of a board edge termination assembly. Then, the end of the communications cable that includes the board edge termination assembly is routed through the walls of a building to an opening that is configured to receive the communications jack. Next, the communications jack is mated with the board edge termination assembly. Then, the communications jack is inserted into place in the opening that is configured to receive the communications jack. In other embodiments, the communications cable can be routed through the wall to the wall mount location. The board edge termination assembly can be installed onto the end of the communications cable at the wall mount location. Next, the communications jack is connected to the board edge termination assembly and the jack is mounted in the wall mount.

DETAILED DESCRIPTION

Figure 1:
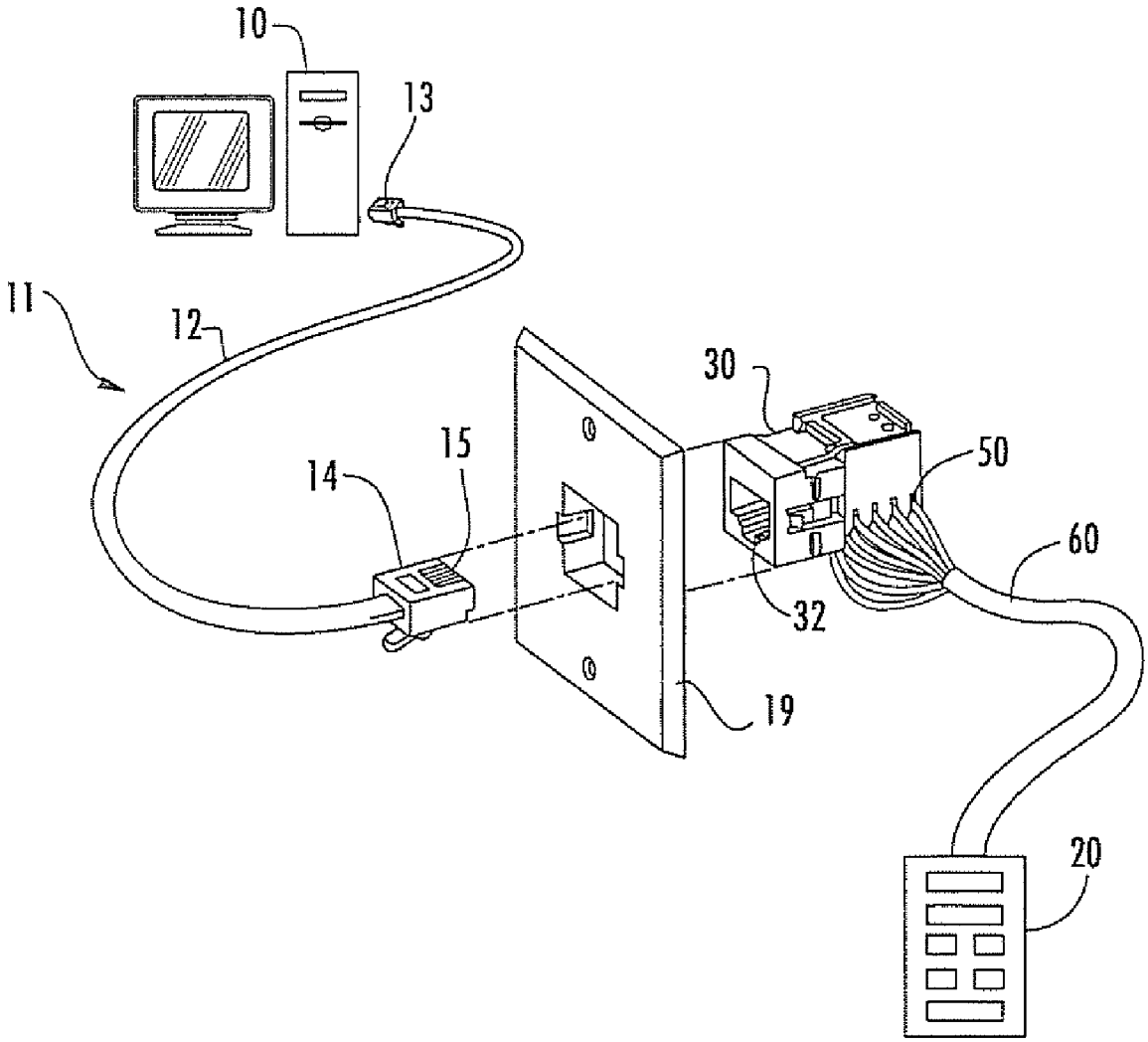
FIG. 1 (PRIOR ART)
FIG. 1 is a schematic drawing that illustrates the use of communications plug/jack connectors to connect a computer to network equipment.

The present invention will be described more particularly hereinafter with reference to the accompanying drawings. The invention is not intended to be limited to the illustrated embodiments; rather, these embodiments are intended to fully and completely disclose the invention to those skilled in this art. In the drawings, like numbers refer to like elements throughout. Thicknesses and dimensions of some components may be exaggerated for clarity.

Spatially relative terms, such as"under", "below", "lower", "over", "upper", "top", "bottom" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly.

Well-known functions or constructions may not be described in detail for brevity and/or clarity. As used herein the expression "and/or" includes any and all combinations of one or more of the associated listed items.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises", "comprising", "includes" and/or "including" when used in this specification, specify the presence of stated features, operations, elements, and/or components, but do not preclude the presence or addition of one or more other features, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

This invention is directed to communications connectors, with a primary example of such being a communications jack. As used herein, the terms "forward", "forwardly", and "front" and derivatives thereof refer to the direction defined by a vector extending from the center of the jack toward the plug opening of the jack. Conversely, the terms "rearward", "rearwardly", and derivatives thereof refer to the direction directly opposite the forward direction; the rearward direction is defined by a vector that extends away from the plug opening toward the remainder of the jack. The term "horizontal" is used to refer to planes that are generally parallel to the plane defined by the base of the plug opening, while the term "vertical" is used to refer to planes that are generally parallel to the front face of the plug opening. The terms "laterally" and "transversely" are used to refer to movement in a horizontal plane. Where used, the terms "attached", "connected", "interconnected", "contacting", "mounted" and the like can mean either direct or indirect attachment or contact between elements, unless stated otherwise.

Figure 4:
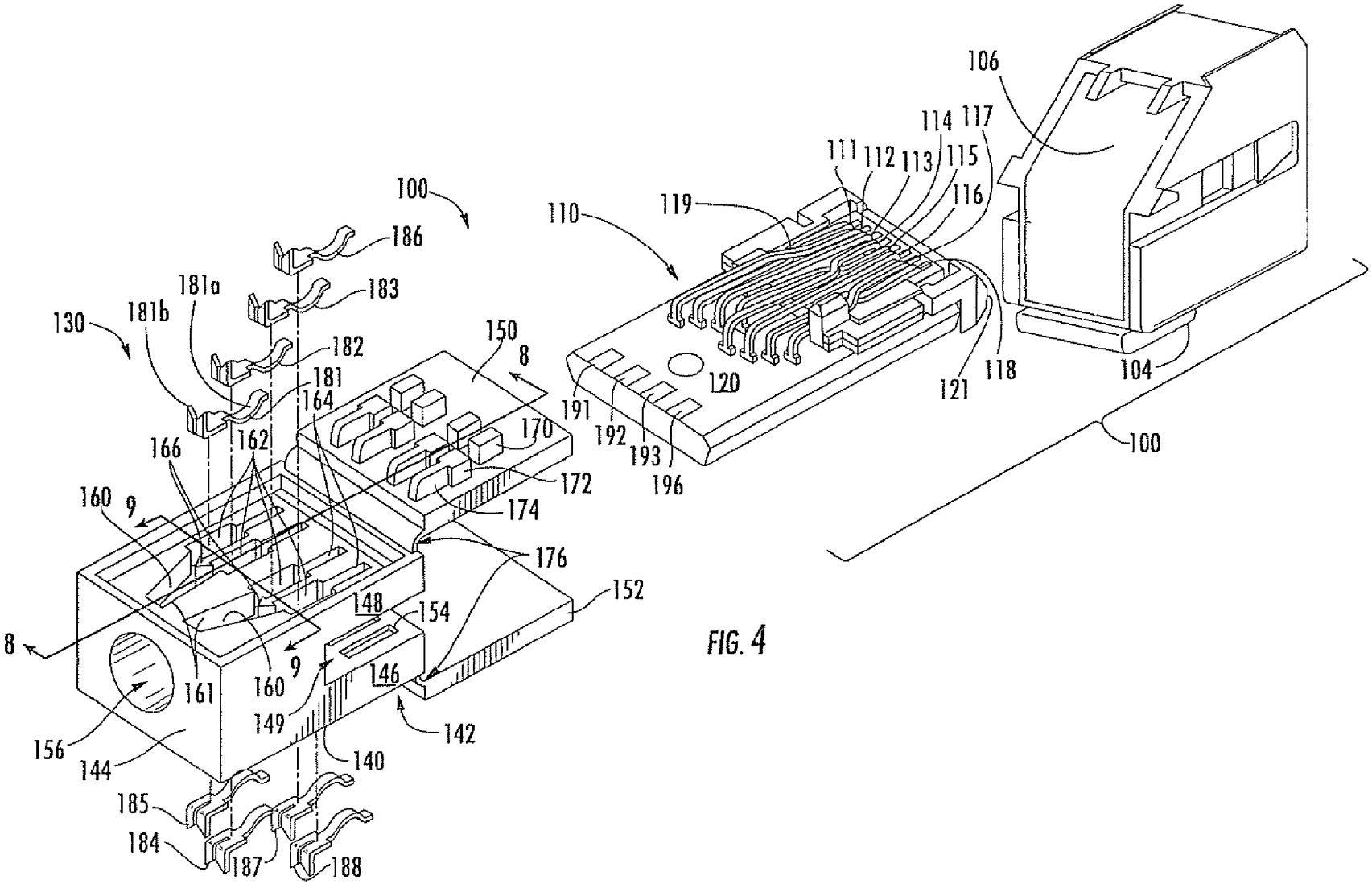
FIG. 4 is an exploded perspective view of a communications jack that includes a board edge termination assembly according to embodiments of the present invention.
Figure 5:
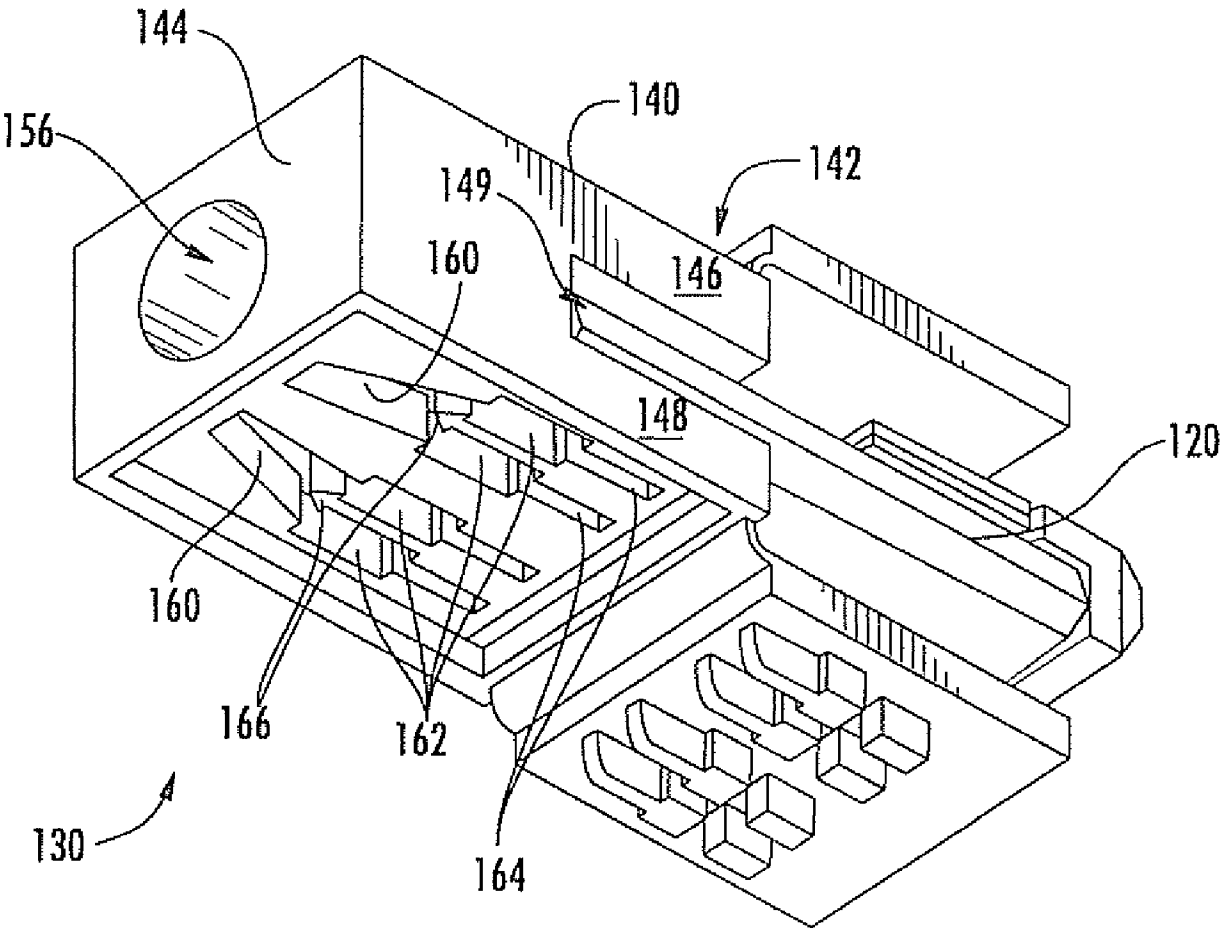
FIG. 5 is a perspective view of the board edge termination assembly of FIG. 4.

FIGS. 4-10 depict a communications jack 100 according to some embodiments of the present invention. In particular, FIG. 4 is an exploded perspective view of a communications jack 100 according to embodiments of the present invention that includes a board edge termination assembly 130. FIG. 5 is a perspective view of the board edge termination assembly 130 of FIG. 4 with the communications insert 110 inserted into the board edge termination assembly 130. As shown in FIG. 4, the communications jack 100 includes a jack frame 104 having a plug aperture 106 for receiving a mating plug (the mating plug is not shown in FIG. 4), a communications insert 110 that includes input contacts 111-118, and a board edge termination assembly 130. Any conventional jack frame 104 may be used, and hence the jack frame 104 is not described in detail herein. In the embodiment of FIGS. 4-10, the jack frame 104 comprises the entire housing for the communications jack 100. However, it will be appreciated that in other embodiments the housing may include additional and/or different components that at least partially surround and protect various components of the communications jack and/or which serve to define the plug aperture 106. It will also be appreciated that the communications jack 100 of FIGS. 4-10 would typically be inverted when installed so that the input contacts 111-118 are suspended into an upper portion of the plug aperture 106, as such an orientation can reduce buildup of dust and dirt on the input contacts 111-118 that may degrade the electrical connection between the plug blades and the input contacts 111-118.

The communications insert 110 is received into an opening in the rear of the jack frame 104. The communications insert 110 includes a printed circuit board 120, which may be formed of conventional materials. Specialized printed circuit boards such as, for example, flexible printed circuit boards may also be used. In the embodiment of the present invention depicted in FIGS. 4-10, the printed circuit board 102 comprises a multi-layer printed circuit board that is substantially planar. As shown in FIG. 4, the input contacts 111-118 may comprise conventional spring jackwire contacts that are configured to mate with the respective blades of a mating communications plug such as, for example, the jackwire contacts described in U.S. Pat. No. 6,350,158. The jackwire contacts may include crossovers and/or bends that are designed to reduce crosstalk and/or introduce compensatory crosstalk. Moreover, in certain embodiments of the present invention, other types of input contacts 111-118 may be used such as, for example, jackwire contacts that are formed as part of a flexible printed circuit board. In the embodiment of FIGS. 4-10, the eight jackwire contacts 111-118 are mounted on a top surface of the printed circuit board 120. Each of the jackwire contacts 111-118 has a termination end that is mounted in a central portion of the printed circuit board 120, and a distal end that terminates underneath a mandrel that is mounted adjacent a forward portion of the top surface of the printed circuit board 120. Each of the jackwire contacts 111-118 extends into the plug aperture 106 to make physical and electrical contact with the blades of a mating communications plug (not shown). In this particular embodiment, the distal end 111-118 of each contact is a "free" end that is not mounted in the printed circuit board 120 or in another substrate, and hence can deflect when the communications plug is inserted into the plug aperture 106 of communications jack 100.

Each jackwire contact 111-118 may be mounted to the printed circuit board 120 via insertion into a respective metal-plated aperture (not shown in FIG. 4) in the printed circuit board 120. Each jackwire contact 111-118 may be interference fit within its respective aperture. In the embodiment of FIG. 4, the apertures are arranged in a "dual diagonal" pattern known to those skilled in this art as described in U.S. Pat. No. 6,196,880 to Goodrich et al. The jackwire contacts 111-118 may have substantially the same profile, as shown in FIG. 4, and may be substantially transversely aligned in side-by-side relationship. Likewise, the jackwire contacts 111-118 may include crossovers such as crossover 119. However, it will be appreciated that any jackwire contact configuration may be used. Thus, in other embodiments of the present invention, the jackwire contacts 111-118 may, for example, have different profiles, may not be in a generally side-by-side relationship (except in the "contact" region where the jackwire contacts physically contact a mating communications plug to the extent required by industry standards), may or may not include one or more crossovers, and may be oriented differently with respect to the printed circuit board.

The communications insert 110 also includes a plurality of output contacts 191-198 (only output contacts 191-193 and 196 are visible in FIG. 4; output contacts 194-195 and 197-198 are provided on the bottom side of the rear portion of the printed circuit board 120 so as to be aligned with channels 164 in FIG. 5). Contacts 191-198 are referred to herein as "output contacts" because they are the contacts that are used to electrically connect a plurality of conductive paths on the printed circuit board 120 to the respective conductors of a communications cable that connects to the back end of the communications jack 100. This is in contrast to the "input contacts" 111-118, which are the contacts that are used to electrically connect the conductive paths on the printed circuit board 120 to the respective blades of a mating communications plug. In the particular embodiment of the present invention depicted in FIG. 4, the output contacts 191-198 comprise contact pads that are provided on the top and/or bottom surface of the printed circuit board 120, typically adjacent the rear edge of the printed circuit board 120. Each contact pad 191-198 may comprise a conductive element that mates with a respective contact member provided in the board edge termination assembly 130 (described below) so as to electrically connect the contact member in the board edge termination assembly 130 to one of the conductive paths on the printed circuit board 120. The contact pads 191-198 may, for example, comprise immersion tin plated copper pads, gold plated pads, small gold plated nail heads, carbon ink pads, etc. In other embodiments of the present invention, different types of output contacts may be used such as, for example, metal wires or IDCs.

As noted above, a conductive path extends between each jackwire contact 111-118 and a respective one of the contact pads 191-198. Each conductive path may comprise, for example, one or more conductive traces that are provided on one or more layers of the printed circuit board 120. When a conductive path includes conductive traces that are on multiple layers of the printed circuit board 120, metal plated or metal filled through holes (or other layer-transferring structures known to those skilled in this art) may be provided that provide an electrical connection between the conductive traces on different layers of the printed circuit board 120. The conductive traces may be formed of conventional conductive materials such as, for example, copper, and may be deposited on the printed circuit board 120 via any deposition method known to those skilled in this art to be suitable for the application of conductors.

As noted above, the communications jack further includes a board edge termination assembly 130. A "board edge termination assembly" refers to a detachable assembly (not that the assembly may, in some embodiments, comprise a one piece assembly) that is used to electrically connect the conductors of a communications cable to a printed circuit board of a communications jack. As shown in FIG. 4, the board edge termination assembly 130 includes a body 140 and a plurality of contact members 181-188. The body 140 includes a forward portion 142 and a rear portion 144. The forward portion 142 includes first and second spaced apart shelves 146, 148. The shelves 146, 148 define an opening 149 therebetween which receives the rear edge of printed circuit board 120. The rear portion 144 includes an aperture 156 that may receive a communications cable 60 (not pictured in FIG. 4) that is connected to the communications jack 100. It will be appreciated that the shelves 146, 148 may take on a wide variety of shapes, need not be generally flat or elongated, may each be formed of multiple pieces, etc. By way of example, in an alternative embodiment the shelves 146, 148 may each simply comprise two narrow prongs or protrusions, and the printed circuit board is received between the protrusions of such shelves 146, 148. Numerous other shelf designs are possible. The board edge termination assembly 130 may be formed of, for example, polycarbonate, ABS, ABS/polycarbonate blend or like dielectric molded materials.

Figure 3:
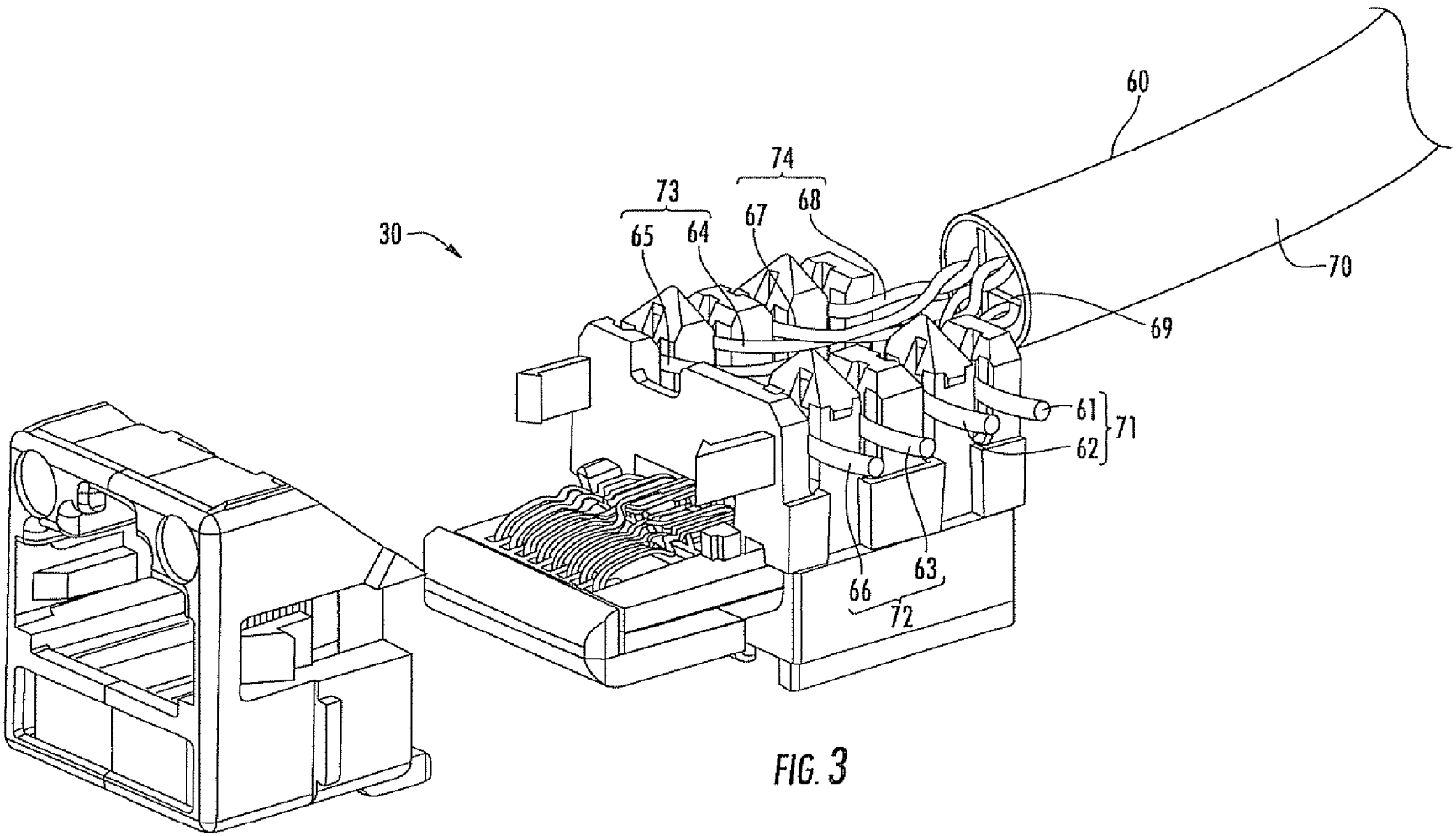
FIG. 3 is a perspective view of the communications jack of FIGS. 1-2 with a communications cable terminated thereon.

As shown in FIGS. 4-5, the top and bottom surfaces of the body 140 each include two recessed areas 160. The rear portion 161 of each recessed area 160 is connected by a passage such as a channel or an opening (not visible in FIGS. 4-5) to the aperture 156 which receives the communication cable. As discussed above with respect to FIG. 3, the communications cable 60 includes eight insulated conductors 61-68 which are arranged as four differential pairs 71-74. The individual conductors that comprise each differential pair 71-74 (i.e., conductors 61/62, 63/66, 64/65 and 67/68 according to industry standardized wiring schemes, see, e.g., TIA/EIA-586-B.2.1 standard approved Jun. 20, 2002 and the related standards referenced therein) are twisted about each other, and all four differential pairs 71-74 are twisted about each other in a "core twist." The end of each of the conductors 61-68 is passed through a respective one of the above-mentioned passages that connect aperture 156 and each recessed area 160 into the rear portion 161 of each recessed area 160. This is more clearly illustrated in FIG. 6 and the discussion thereof herein.

Each recessed area 160 further includes a twist terminator 166 that may be used to consistently set the location where the differential pairs 71-74 received within the respective recessed areas 160 switch from a twisted to an untwisted configuration. In the embodiment depicted in FIGS. 4-10, the twist terminator 166 includes a pointed, or knife-like, ridge that may help a technician to separate the individual conductors 61-68 within each differential pair 71-74. Each recessed area 160 further includes a pair of cavities 162 that are separated by a vertical wall. Each recessed area 160 also includes a pair of channels 164 that extend from respective forward portions of the cavities 162.

As is also shown in FIGS. 4-5, the board edge termination assembly 130 includes a plurality of contact members 181-188. The contact members 181-188 may comprise any conductive elements that electrically connect the conductors of a communications cable such as communications cable 60 to respective one of a plurality of conductive paths on the printed circuit board 120 of communications jack 100. For example, in some embodiments, the contact members 181-188 may comprise contact "wires" (which may be round or, more typically, formed of thin pieces of stamped metal) that each include a spring contact portion 181*a*-188*a* (i.e., a deflectable portion that is designed to make mechanical and electrical connection with a corresponding contact or contact pad) and a wire termination portion 181*b*-188*b* (i.e., a portion to which a wire or other conductor may be terminated or attached). As shown more clearly in FIG. 8, the spring contact portion 181*a*-188*a* in some embodiments of the present invention may comprise an elongate strip of stamped metal which is formed into a curved or arcuate shape. The end of the spring contact portion 181*a*-188*a* of each contact member 181-188 may be unrestrained (i.e. each end constitutes a "free" end) so that the spring contact portion may deflect and create a spring force when a force is applied to the curved or arcuate section 181*a*-188*a* with the aid of protrusions 170, 172, and 174 pressing against the conductors, the wire termination portions 181*b*-188*b*, and the contact members 181-188. The wire termination portion 181*b*-188*b* may comprise, for example, an IDC that receives an insulated conductor and cuts the insulation to make both mechanical and electrical connection with the conductor. As shown in FIGS. 4-5, each cavity 162 in body 140 of board edge termination assembly 130 is configured to receive the wire termination portion 181*b*-188*b* of one of the contact members 181-188. Likewise, each channel 164 is configured to receive the spring contact portion 181*a*-188*a* of a respective one of the contact members 181-188.

Figure 8:
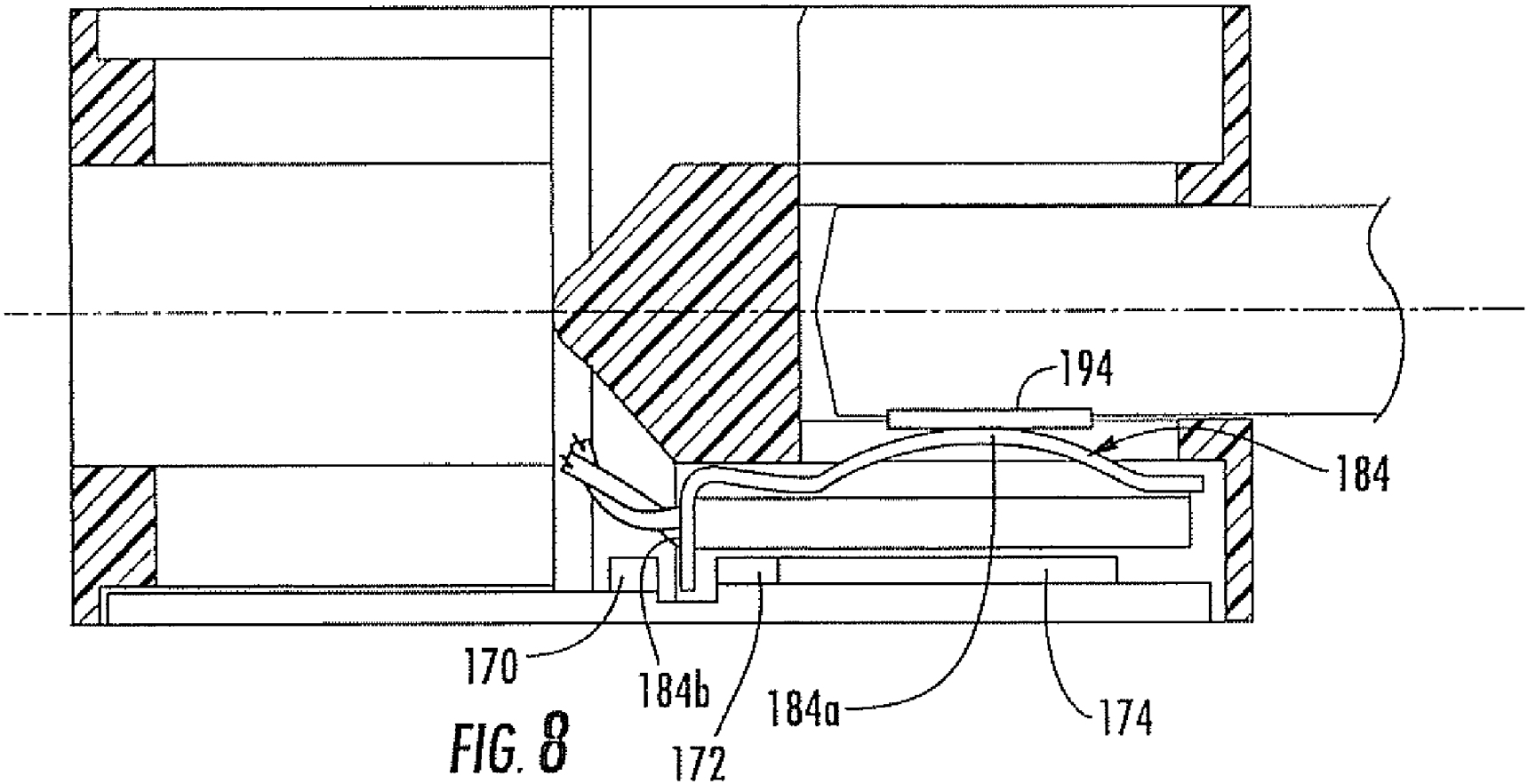
FIG. 8 is cross-sectional view of the board edge termination assembly taken along the line 8-8 of FIG. 4 once the board edge termination assembly has been closed into the configuration of FIG. 7.

First and second pivotable caps 150, 152 are connected to forward portion 142 of body 140. As shown in FIG. 4, each pivotable cap 150, 152 connects to a respective one of the shelves 148, 146 by a respective hinge 176. Each pivotable cap 150, 152 includes a plurality of first protrusions 170, a plurality of second protrusions 172 and a plurality of third protrusions 174 on an inner face thereof. As shown in FIGS. 4 and 8, the pivotable caps 150, 152 are designed so that when moved to a closed position by pivoting each cap 150, 152 about its respective hinge so that the caps 150, 152 close over the respective upper and lower surfaces of the body 140, each of the plurality of first protrusions 170 will reside within the rear portion 161 of one of the recessed areas 160 just outside of one of the cavities 162. Similarly, the pivotable caps 150, 152 are designed so that, when in a closed position, each of the plurality of second protrusions 172 will reside within a respective one of the cavities 162, and each of the plurality of third protrusions 174 will reside within a respective one of the channels 164. As will be discussed in more detail herein, with this configuration the pivotable caps 150, 152 may serve as stuffer caps that hold the contact members 181-188 in place and seat respective conductors 61-68 from communication cable 60 in the respective wire termination portions 181*b*-188*b* of each contact member 181--188 (see discussion below). A shown in FIGS. 4-5, the pivotable caps 150, 152 may have substantially the same design except that the locations of the protrusions 170, 172, 174 may be offset on the two caps 150, 152, as discussed in more detail herein, for purposes of potentially providing improved crosstalk performance in certain embodiments of the present invention.

Figure 6:
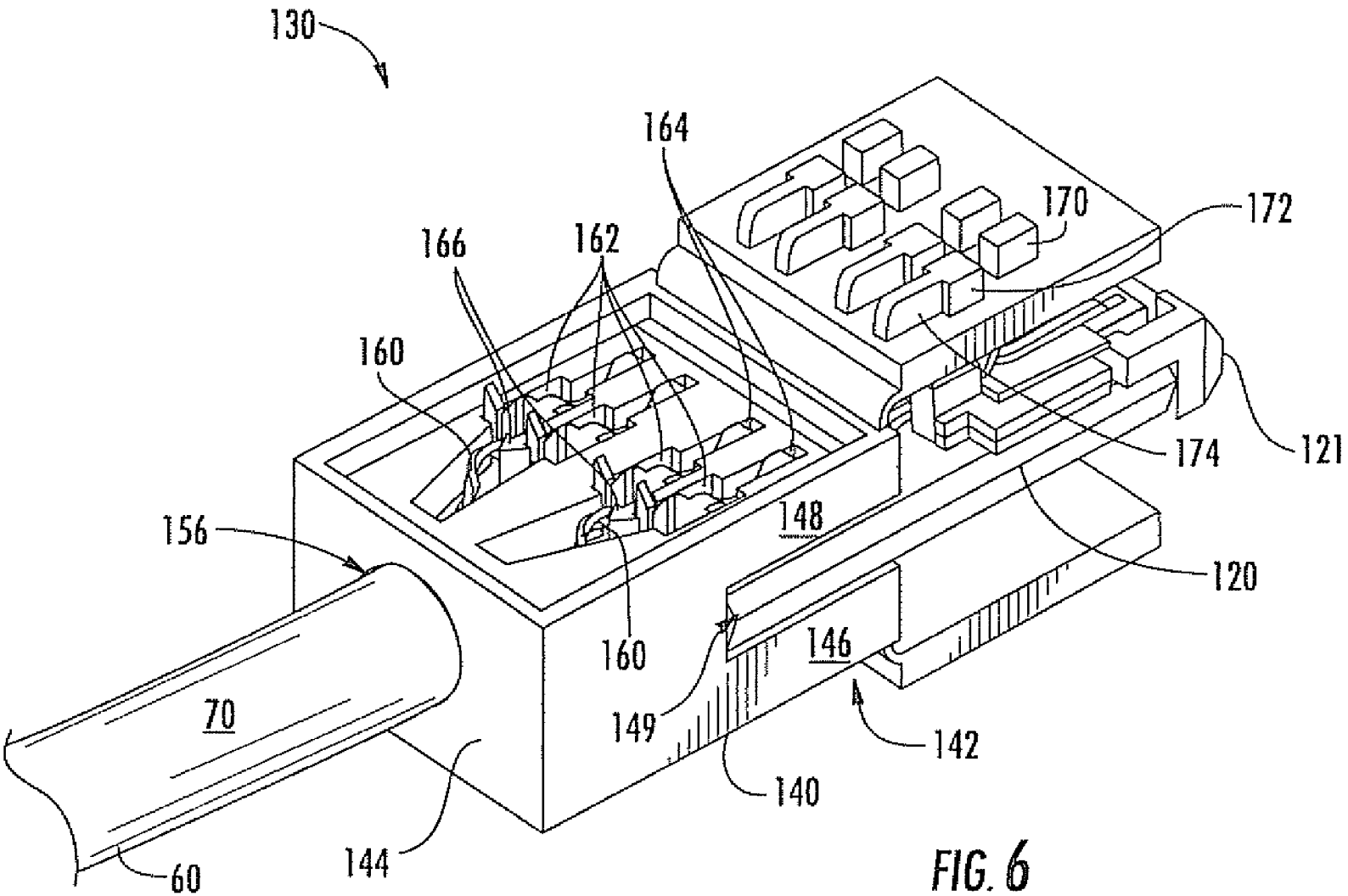
FIG. 6 is a perspective view of the board edge termination assembly of FIG. 4 with a communications cable partially terminated thereon.

FIG. 6 is a perspective view of the board edge termination assembly 130 of FIGS. 4-5 with the communications cable 60 terminated thereon (except for the closing of the pivotable caps 150, 152). As shown in FIG. 6, one end of the communications cable 60 is inserted into the aperture 156. While the jacket 70 of cable 60 will typically be removed from the end most portion of communications cable 60 in order to allow access to each of the differential pairs of conductors included in communications cable 60, the jacket 70 may remain on the portion of communications cable 60 that extends into aperture 156. Moreover, while not shown in the figures, a cable strain relief mechanism such as, for example, an anchor bar that engages the jacketed cable and firmly holds the jacketed cable against a strain relief housing, or a compressible wedge collar that surrounds the jacketed cable and pinches against the jacketed cable when snapped into an associated strain relief housing, may be included in the rear portion 144 of body 140. Once the communications cable 60 is inserted into apertures 156, this cable strain relief mechanism may be locked into place against the jacket 70 in order to provide strain relief in the event that communications cable 60 is pulled after the board edge termination assembly 130 is attached thereto. By having the cable strain relief mechanism contact a jacketed portion of the communications cable 60, it may be possible to better maintain each differential pair in its proper position within the cable, which may help reduce the overall crosstalk levels.

As is further shown in FIG. 6, each differential pair 71-74 of conductors 61-68 passes through a respective one of the passages that connect each recessed area 160 to the aperture 156 (only two of the differential pairs are visible in FIG. 6; the other two pairs would be placed in the openings 160 on the reverse side of body 140). In the rear portion 161 of each recessed area 160 to conductors 61-68 of each respective differential pair 71-74 may remain twisted together. Each twist separator 166 may be used to define the region where each respective differential pair 71-74 transitions from a twisted to an untwisted state. The untwisted end of each conductor 61-68 is placed over the wire termination portion 181*b*-188*b* of a respective one of contact members 181-188. The conductor 61-68 may then be lodged into place between the opposed arms of the wire termination portion 181*b*-188*b* of the contact member 181-188 by either hand manipulation of the conductor or by pivoting the appropriate pivotable cap 150, 152 into its closed position such that the first and second protrusions 170, 172 force each conductor 61-68 into place between the opposed arms of the wire termination portion 181*b*-188*b* of its respective contact member 181-188.

The use of board edge termination assembly 130 or other board edge termination devices according to embodiments of the present invention may allow an installer to seat the conductors 61-68 of each of the differential pairs 71-74 into the wire connection terminals 181*b*-188*b* of the communications jack 100 independent of the location of the communications jack 100. Thus, for example, an installer may pre-terminate a large number of communications cables at a desk or work area by, for example, using the wire termination procedure discussed above with respect to FIG. 6 to terminate each communications cable into a respective board edge termination assembly 130, then later snap each board edge termination assembly 130 of each pre-terminated communications cable into place on the end of a communications jack 100. This ability to terminate the communications cable at a location separate from the location of the communications jack may be more convenient for the installer, since communications jacks are often located in areas that only provide limited access to the communications jack such as in patch panels or wall plates.

Figure 11A:
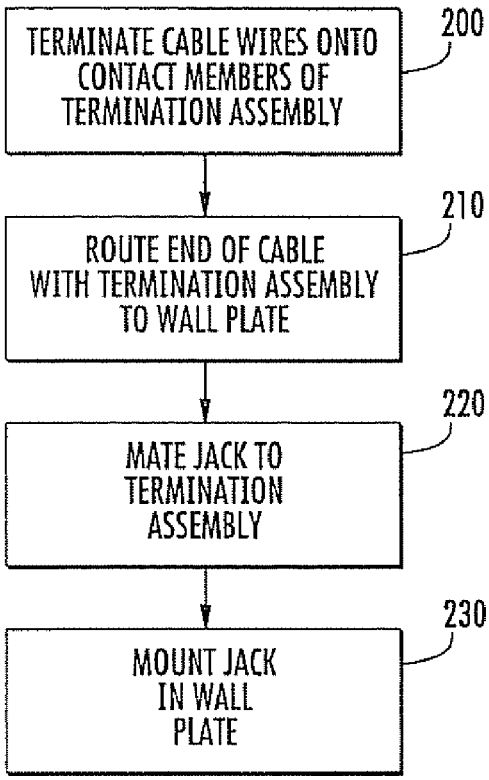
FIGS. 11A and 11B are flow charts detailing operations for terminating a communications cable that includes a plurality of differential pairs of conductors to a communications jack according to certain embodiments of the present invention.

FIG. 11A illustrates a method of terminating a communications cable that includes a plurality of differential pairs of conductors to a communications jack according to certain embodiments of the present invention. As shown in FIG. 11A, operations may begin with a technician or installer terminating each of the conductors of the plurality of differential pairs of conductors into a respective contact member of a board edge termination assembly (block 200). In many cases, a large number of cables will be terminated onto respective board edge termination assemblies at one time, at a location remote from the location(s) where the communications jacks will actually be mounted. In some cases, predetermined lengths of communications cables may be terminated onto the board edge assemblies at the factory with precut lengths of cable. Next, the end of the communications cable that includes the board edge termination assembly is routed through the walls and/or ceiling, or office furniture raceways and partitions, of a building to (and possible through) an opening that is configured to receive the communications jack (block 210). Next, the communications jack and the board edge termination assembly are mated together by, for example, inserting the printed circuit board of the communications jack into an opening in the board edge termination assembly (block 220). Finally, the communications jack with the mated board edge termination assembly may be inserted into place in the opening that is configured to receive the communications jack (block 230). Note that in order to facilitate such operations, the board edge termination assembly may need a smaller cross-section than does a jack housing of the communications jack so that the board edge termination assembly may fit through the opening in the wall plate that receives the communications jack.

Figure 11B:
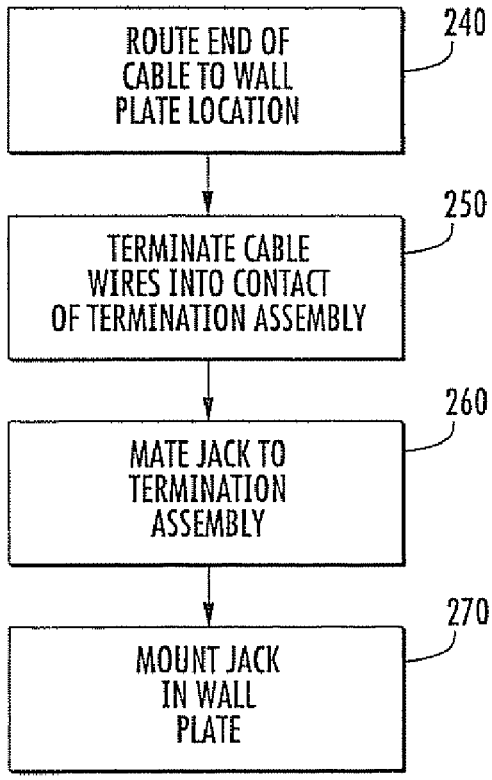

FIG. 11B illustrates methods of terminating a communications cable that includes a plurality of differential pairs of conductors to a communications jack according to further embodiments of the present invention. As shown in FIG. 11B, operations may begin with a technician or installer routing an end of each cable through the walls, ceiling, office furniture raceways and/or partitions to respective wall mount locations (block 240). Next, the technician terminates each of the cables onto its respective communication jack by terminating each conductor of each cable into a respective contact member of a board edge termination assembly that is associated with each respective communication jack (block 250). Next, the communications jack and the board edge termination assembly are mated together by, for example, installing the printed circuit board of the communications jack into the opening into the board edge termination assembly (block 260). Finally, the communications jack with the mated board edge termination assembly may be inserted into place in the opening that is configured to receive the communications jack (block 270).

Other installation procedures may be used when, for example, installing communications jacks in closet racks. Several communications jacks can be snapped into the racks. The board edge termination assembly can be attached to each cable. Next, each board edge termination assembly can be plugged onto the back end of a respective one of the pre-installed communications jacks.

Figure 7:
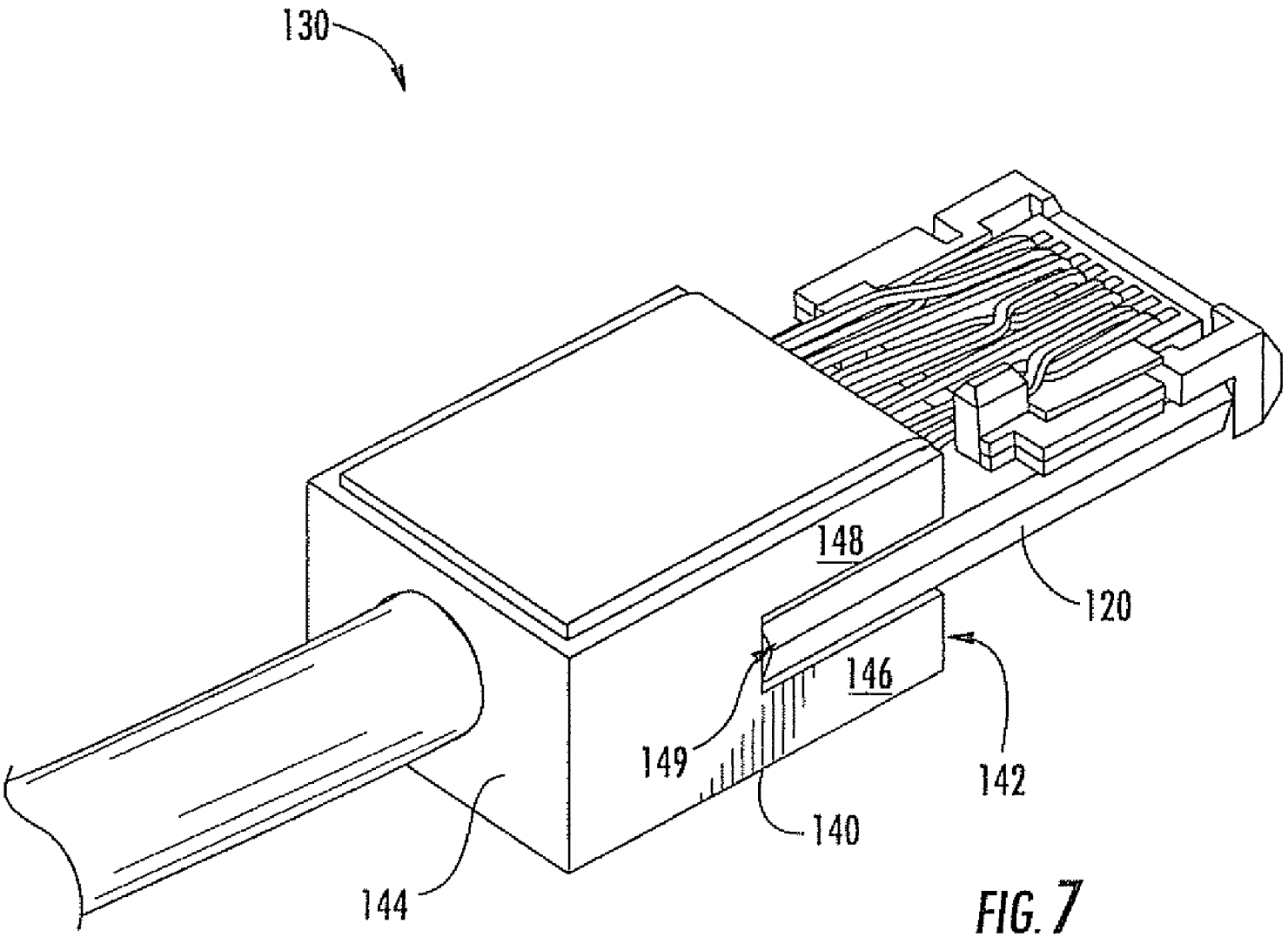
FIG. 7 is a perspective view of the communications jack of FIG. 4 with the board edge termination assembly installed thereon.

FIG. 7 is a perspective view of the communications jack of FIG. 4 after all of the conductors 61-68 of cable 60 have been terminated into their respective contact members 181-188, and after the pivotable caps 150, 152 have been moved into their closed positions. While not shown in FIG. 7, releasable snap clips, latches or other connection mechanisms may be provided on body 140 and/or on pivotable caps 150, 152 so that pivotable caps 150, 152 are held securely in place once pivoted into their closed positions. The protrusions 170, 172, 174 on pivotable caps 150, 152 may act to securely hold contact members 181-188 and/or conductors 61-68 of communications cable 60 in place onto the pivotable caps 150, 152 are pivoted into their respective closed positions. In FIG.

7, the board edge termination assembly 130 has also been moved into place over the rear edge of printed circuit board 120 so that each contact member 181-188 makes mechanical and electrical connections with a respective one of the contact pads 191-198 as discussed in more detail below with respect to FIG. 8. As shown in FIG. 7, the rear edge of printed circuit board 120 fits into the opening 149 defined between the shelves 146, 148 of board edge termination assembly 130. In some embodiments of the present invention, the board edge termination assembly 130 may be configured or keyed to a feature on printed circuit board 120 (e.g. a slot) such that it will only fit over the rear edge of printed circuit board 120 in one orientation so that an installer may not mistakenly install board edge termination assembly 130 onto printed circuit board 120 upside down (which could terminate the conductors 61-68 to the wrong contact pads 191-198 or result in electrical open circuits). Releasable snap clips or other latching or connecting mechanisms (not shown in FIGS. 4-7) may also be provided that securely connect the board edge termination assembly 130 to the rear of the communications jack 100.

FIG. 8 is a cross-sectional view of the board edge termination assembly 130 taken along the line 8-8 of FIG. 4 once the board edge assembly has been closed into the configuration of FIG. 7. As can be seen, FIG. 8 provides a cross-sectional view of contact member 184, and shows how contact member 184 makes mechanical and electrical connections to corresponding contact pad 194 on printed circuit board 120. As discussed above, contact member 184 includes a wire termination portion 184*b* and a spring contact portion 184*a*. As shown best in FIG. 4, the inner surface of each shelf 146, 148 includes a plurality of slots 154. The spring contact portions 181*a*-188*a* of each contact member 181-188 extend through a respective one of these slots 154 into the opening 149 between shelves 146, 148. As illustrated in FIG. 8, when the board edge termination assembly 130 is placed over the back end of the printed circuit board 120, the spring contact portions 181*a*-188*a* of contact members 181-188 deflect away from the printed circuit board. This deflection is made possible since the far end of the spring contact portions 181*a*-188*a*is not mounted in the body 140 and is free to move normally relative the surface of the printed circuit board 120. Each spring contact portion 181*a*-188*a* is positioned so that when the printed circuit board 120 is inserted into opening 149, the spring contact portion 181*a*-188*a* is both laterally and vertically aligned with one of the contact pads 191-198 that are provided on the upper or lower surfaces of the rear of printed circuit board 120. Each spring contact portion 181*a*-188*a* of contact members 181-188 "wipes" against its respective contact pad 191-198. This "wiping action" facilitates clearing away dust or dirt that may be present on the contact pad 191-198 thus providing for good mechanical and electrical connection between each contact member 181-188 and its corresponding contact pad 191-198.

Figure 9:
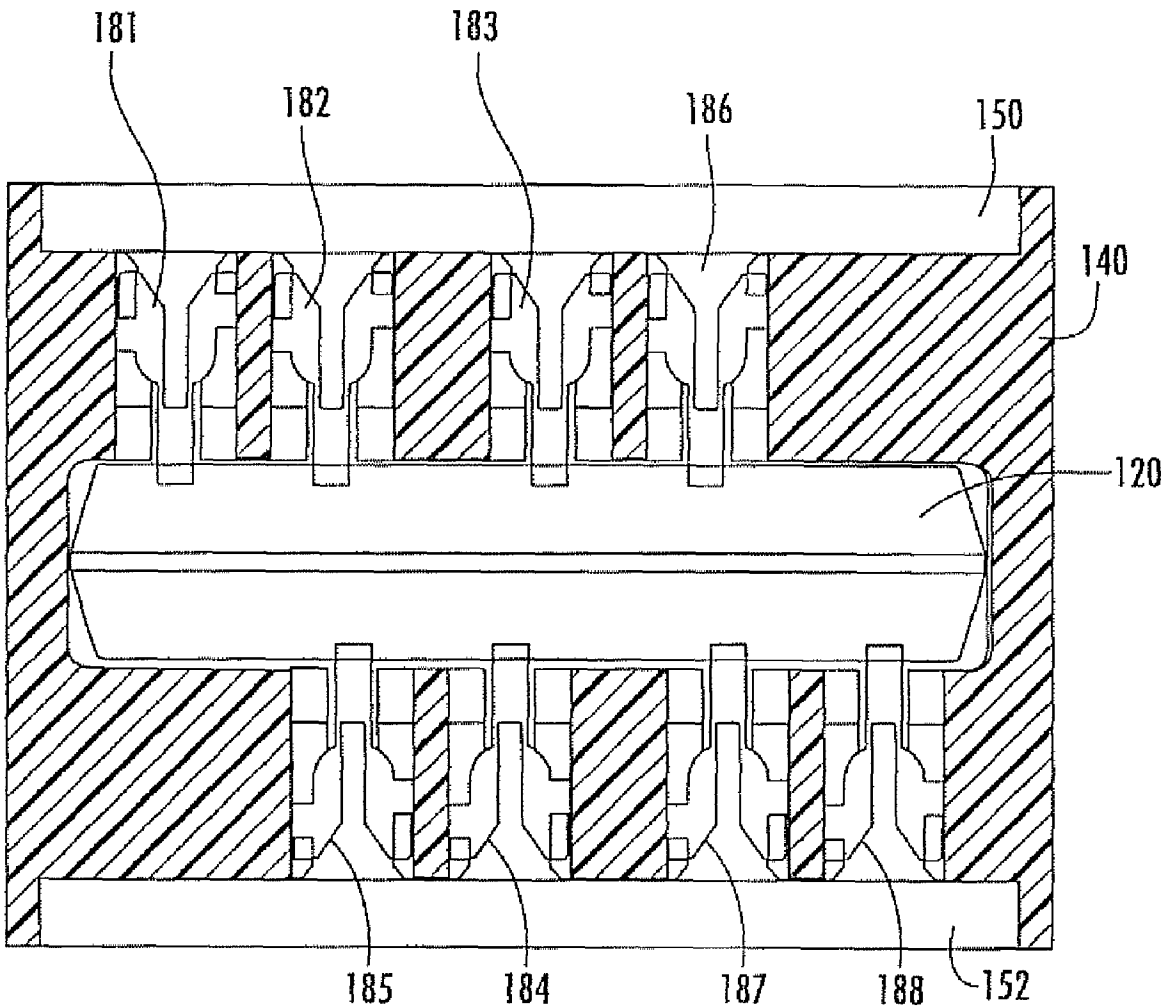
FIG. 9 is cross-sectional view of the board edge termination assembly taken along the line 9-9 of FIG. 4 once the board edge termination assembly has been closed into the configuration of FIG. 7.

FIG. 9 is a cross-sectional view of the board edge termination assembly 130 taken along the line 9-9 of FIG. 4 once the board edge assembly has been closed into the configuration of FIG. 7. As shown in FIG. 9, contact members 181-183 and 186, which mate with the contact pads 191-193 and 196 that are on the top surface of printed circuit board 120, are not transversely aligned with contact members 184-185 and 187-188, which mate with the contact pads 194-195 and 197-198 that are on the bottom surface of printed circuit board 120. In particular, contact members 181, 182, which are part of a first differential pair, are positioned above the far left side of printed circuit board 120, contact members 183, 186, which are part of a second differential pair, are positioned above the right-central portion of printed circuit board 102, contact members 184, 185, which are part of a third differential pair, are positioned below the left-central region of printed circuit board 120, and contact members 187, 188, which are part of a fourth differential pair, are positioned below the far right side of printed circuit board 120. As will be explained in further detail below, this configuration may facilitate reducing the amount of crosstalk introduced in the board edge termination assembly 130 of communications jack 100.

In order to simplify the drawings, the contact members 181-188 are shown as being generally linear. However, it will be appreciated that the arrangement of the wire termination portions 181*b*-188*b*, for example, may make it desirable or necessary to use non-linear contact members 181-188 that, for example, include one or more "jogged" or angled sections.

Figure 10:
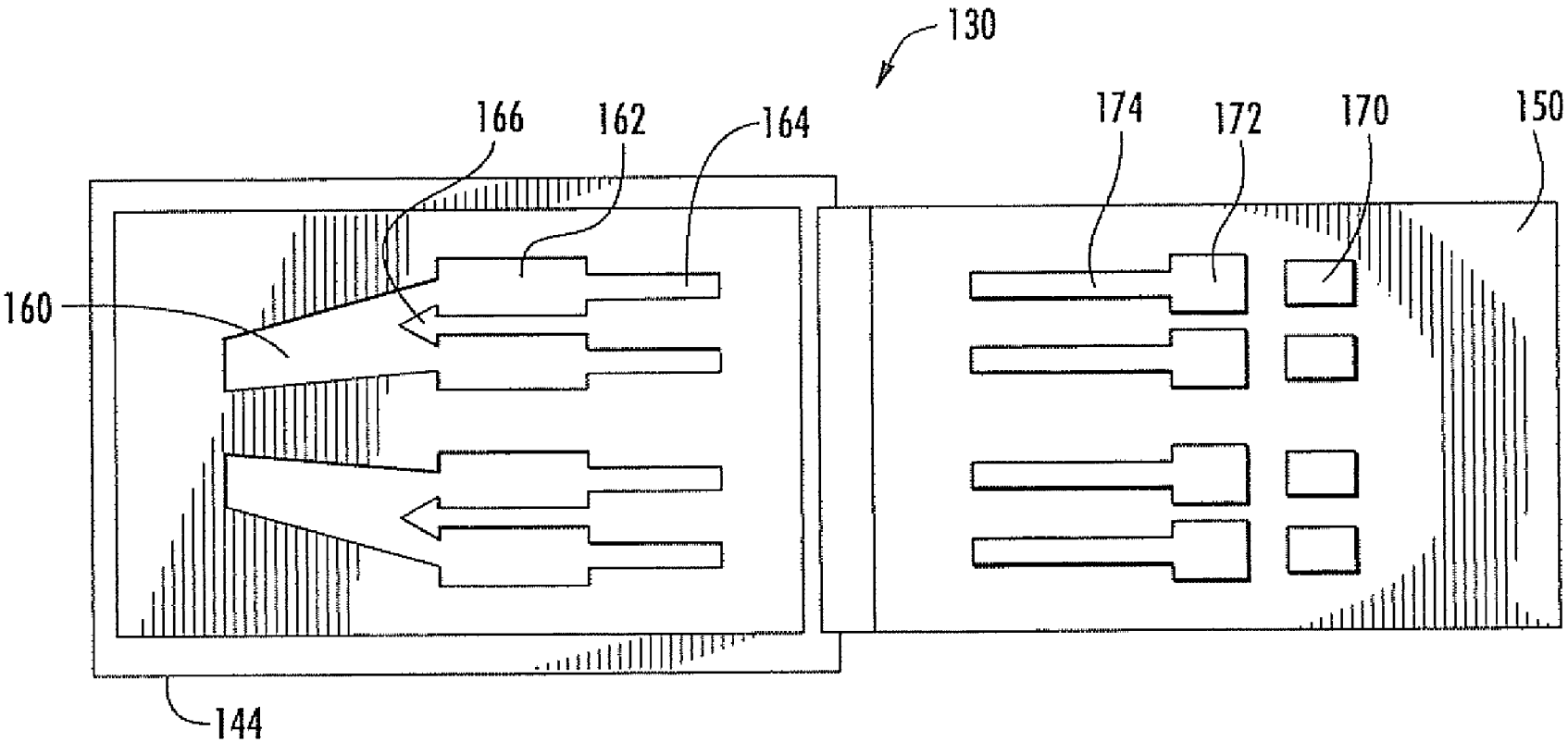
FIG. 10 is a plan view of the board edge termination assembly of FIG. 7 before the pivotable cap is pivoted into place.

FIG. 10 is a plan view of the board edge termination assembly 130 of FIG. 7 before the pivotable cap 150 is pivoted into place.

In certain embodiments of the present invention, the board edge termination assembly 130 may be used to facilitate using communications jacks that have generally horizontally oriented printed circuit boards in communications patch panels. In particular, as is well known to those of skill in the art, a patch panel refers to an assembly that includes a plurality of communications jacks (typically 24 or 48, although other numbers of jacks may be included) that are aligned in rows. Typically, a plurality of patch panels will be mounted on one or more equipment racks in a network computer room of, for example, an office building. In order to allow a large number of communications jacks to be mounted in an accessible manner in a small space, typically each patch panel has a vertical height of 1.75 inches, and a large number of patch panels (e.g., 10 or 12) may be stacked vertically on an equipment rack. Due to this close vertical spacing, it may be difficult to use communications jacks that have horizontally mounted printed circuit boards (i.e., a jack that has a printed circuit board that lies in a plane parallel to the plane defined by the lower surface of the plug aperture), because the wire connection terminals on such horizontally oriented printed circuit boards will typically extend in a vertical direction. As a result, any patch panel mounted on the equipment rack above the patch panel of interest will generally block access to the wire connection terminals of the communications jacks on the lower patch panel. For this reason, communications jacks that are used in patch panels typically have a vertically oriented printed circuit board. On such vertically oriented printed circuit boards, the wire connection terminals typically extend horizontally from the rear surface of the printed circuit board, and thus other patch panels on the equipment rack do not block access to these wire connection terminals.

Using board edge termination assemblies according to embodiments of the present invention, however, makes it both possible and convenient to use communications jacks having horizontally-oriented printed circuit boards in patch panel applications. In particular, the board edge termination assembly 130 may have a sufficiently low profile that it may be inserted onto the end of the printed circuit board of a patch panel communications jack without immediately adjacent patch panels on the equipment rack making it difficult to terminate communications cables to the communications jacks.

Figure 2:
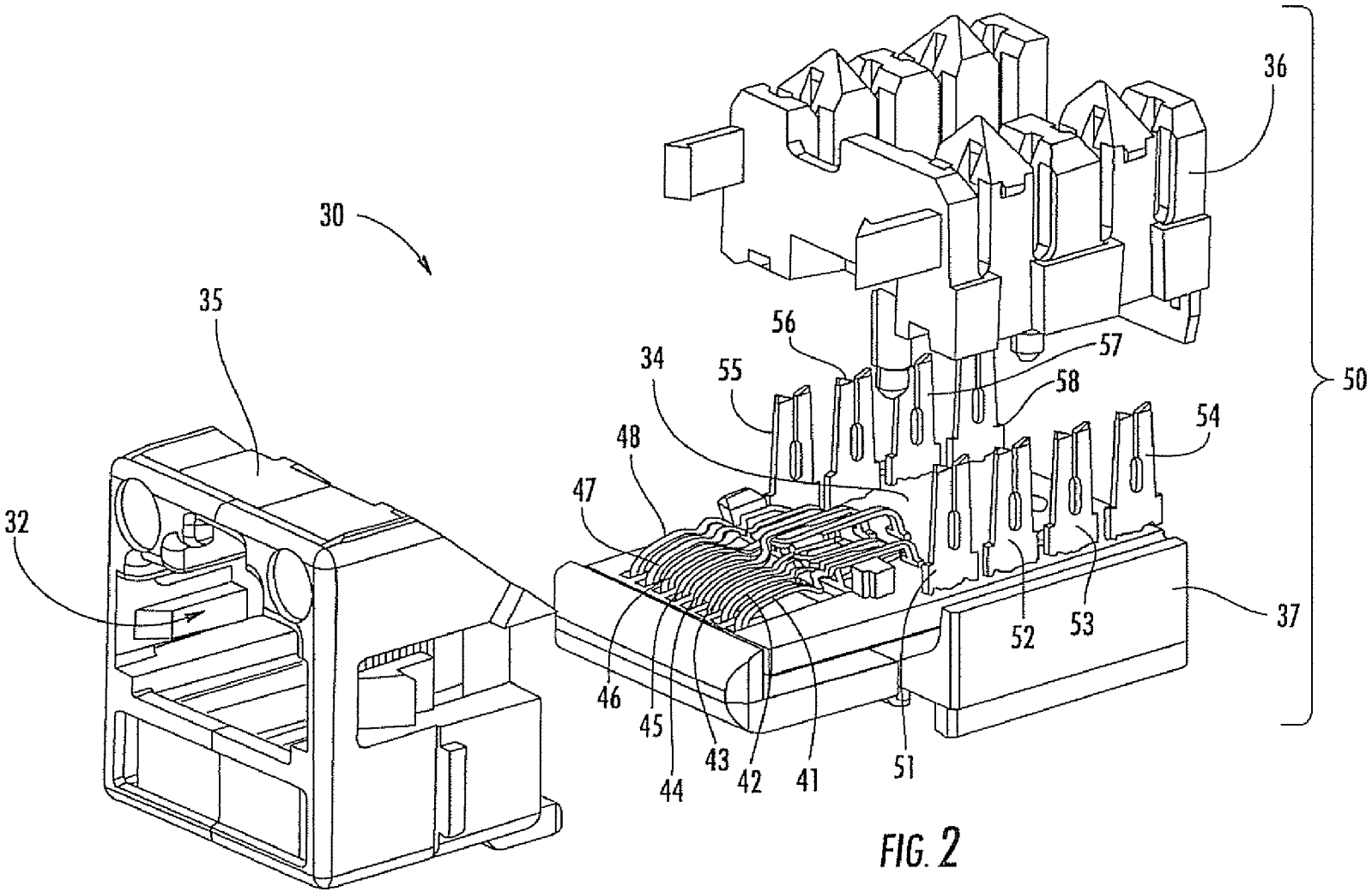
FIG. 2 is an exploded perspective view of the communications jack of FIG. 1.

The use of board edge termination assembly 130 or other board edge terminations according to embodiments of the present invention may also make it easier for installers to change the communications cable that is terminated to a particular communications jack. In particular, as described above with respect to FIGS. 2-3, with most conventional communications jacks, the communications cable is terminated to the back end thereof by individually seating each conductor of the communications cable into a respective insulation displacement contact. Accordingly, in situations in which a second communications cable must later be attached to such a communications jack in place of an already terminated first communications cable, each conductor of the first communications cable must be individually removed from its respective IDC, and then each conductor of the second communications cable must be individually inserted into its respective IDC. Moreover, before the first communications cable can be attached to a second communications jack, it may be necessary to remove a small portion of the jacket at the end of the cable and to clip off the ends of each individual conductor so that an insulated portion of each conductor may be inserted into its respective IDC on the second jack. The above operations may require a significant amount of time, particularly in situations where the terminations on a large number of communications jacks must be changed.

In contrast, with the of board edge termination assemblies according to embodiments of the present invention, a first cable may be readily removed from a communications jack simply by pulling the board edge termination assembly off of the end of the jack and replacing it with a board edge termination assembly that is installed on another communications cable (it may be necessary to depress a latch or some other mechanism in removing the board edge termination that is attached to the first cable if a snap latch or other connection mechanism is included on the board edge termination). This capability is available because the board edge termination assemblies according to embodiments of the present invention may be "releasably attachable" to the back end of a communications jack such that they can be readily removed after they have been attached and connected to a different communications jack. Thus, the board edge termination assemblies according to embodiments of the present invention may, in certain situations, simplify the process of changing the communications cable that is terminated to a communications jack.

The board edge termination assemblies according to embodiments of the present invention may also include features that are designed to reduce the amount of crosstalk added in the back end of communications jack 100. For example, as shown in FIG. 9, the contact members 181-188 may be arranged so that contact members of the same differential pairs 71-74 are placed next to each other. Likewise, the contact members 181-188 of different differential pairs 71-74 may be spaced apart from each other, in both the horizontal and vertical directions. For example, as shown in FIG. 9, contact members 181-182 (the first differential pair) are spaced directly next to each other, but are spaced further apart horizontally from contact members 183-186 (the second differential pair). The same is true for contact members 184-185 (the third differential pair) and contact members 187-188 (the fourth differential pair). Likewise, along the vertical axis each of the four differential pairs are offset from each other in order to minimize unwanted coupling between differential pairs located on the opposite sides of printed circuit board 120.

In addition, the wire termination portion **181*b*-188*b* of each contact member 181-188 may comprise a low-profile IDC that has decreased surface area compared to conventional IDCs that are typically used in communications jacks. Such low-profile IDCs may be used in the board edge termination assembly 130 because the conductor receiving slot wraps around the IDC's 90 degree bend in order to get equivalent deflection range of a 0.240" high IDC as can be seen, for example, with respect to contacts 184, 185, 187 and 188 in FIG. 4**. In certain embodiments of the present invention, the low-profile IDCs may have a height of between about 0.07" to about 0.13" as compared to a typical height of about 0.24" for an exemplary conventional IDC. By decreasing the surface area of the raised portion of each IDC it may be possible to further reduce crosstalk between the various differential pairs.

Likewise, the twist terminators 166 may provide an easy and convenient method by which an installer can determine where each differential pair should transition from a twisted to an untwisted configuration. As the transition point may effect the coupling between differential pairs, and hence the overall amount of crosstalk, by better controlling the location where each differential pair transitions from a twisted to an untwisted states the expected amount of crosstalk that the communications jack will induce in operation may be more precisely known, and hence the jack can be better designed to approximately cancel that crosstalk. Likewise, by allowing the differential pairs to remain twisted right up to the contact members 181-188, the overall amount of crosstalk induced in the board edge termination assembly 130 may be reduced.

Moreover, the arrangement of contact members 181-188 depicted in FIG. 9 may not only facilitate reducing crosstalk between the four differential pairs, it may also facilitate reducing "alien" near end crosstalk ("alien NEXT"), which is crosstalk between the conductors of one cable with the conductors of a different communications cable. This arrangement may be used to maximize separation between a pair and its nearest neighbor in an adjacent connector, since it places it at the opposite face of the printed circuit board, thus reducing align crosstalk.

Figures 12, 13, 14:
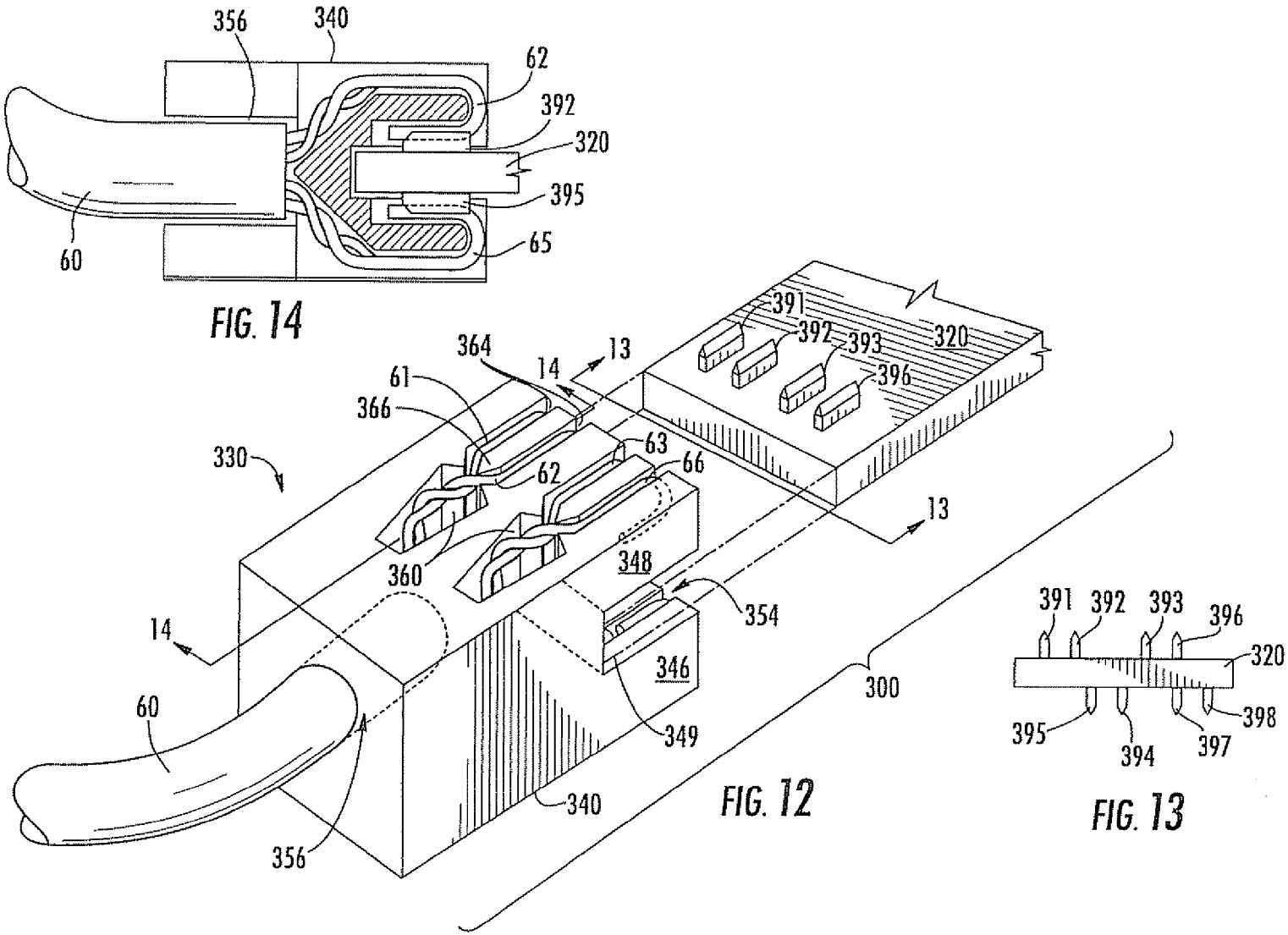
FIG. 12 is a perspective view of a communications jack that includes a board edge termination assembly according to further embodiments of the present invention.
FIG. 13 is cross-sectional view of a printed circuit board of the communications jack of FIG. 12 taken along the line 13-13 of FIG. 12.
FIG. 14 is cross-sectional view of the board edge termination assembly of FIG. 12 taken along the line 14-14 of FIG. 12.

FIG. 12 is a perspective view of a communications jack 300 that includes a board edge termination assembly 330 according to further embodiments of the present invention. FIG. 13 is cross-sectional view of a printed circuit board 320 of communications jack 300 taken along the line 13-13 of FIG. 12. FIG. 14 is cross-sectional view of the board edge termination assembly 330 taken along the line 14-14 of FIG. 12. In FIG. 12, only the board edge termination assembly 330 and the rear portion of the printed circuit board 320 of the communication jack are depicted. It will be appreciated that the remainder of the communication jack 300 may have a variety of different configurations.

As shown in FIG. 12, a plurality of output contacts 391-398 are mounted on the printed circuit board 320 (only output contacts 391-393 and 396 are visible in FIG. 12: output contacts 394-395 and 397-398 are provided on the bottom side of the printed circuit board 320 as shown in FIG. 13). In the embodiment of FIG. 12, the output contacts 391-398 comprise contact blades that are pressed into the printed circuit board 320 (four contacts on each side of the board) adjacent the rear edge of the printed circuit board 320. Each output contact 391-398 may comprise a conductive element (e.g., a steel or copper blade or a gold plated metal strip) that may have a small profile and may include a sharp edge that cuts through the insulation of a respective one of the conductors 61-68 along the axis of the conductor, thereby establishing a sound electrical connection between each output contact 391-398 and a respective one of the conductors 61-68. Each output contact 391-398 may be connected to a respective one of a plurality of conductive paths (not shown) on the printed circuit board 320 which, in turn, are connected to respective input contacts (not shown) of the communications jack 300. Thus, the board edge termination assembly 330 may be used to electrically connect the each of the conductors 61-68 of the cable 60 to a respective input contact of the communications jack 300. It will be appreciated that FIG. 12 is, only, an illustration of the concept. Thus, for example, plastic protection would likely be included around the sharp edges of the contacts 391-398 (not shown). Likewise, alignment flanges may be provided to ensure that the printed circuit board 320 properly aligns with the board termination assembly 330.

The communications jack 300 further includes a board edge termination assembly 330. As shown in FIG. 12, the board edge termination assembly 330 includes a body 340 and first and second spaced apart shelves 346, 348. The shelves 346, 348 define an opening 349 therebetween which receives the rear edge of printed circuit board 320. The portion of the body 340 opposite the shelves 346, 348 includes an aperture 356 that receives a communications cable 60. The board edge termination assembly 330 may be formed of, for example, polycarbonate, ABS, ABS/polycarbonate blend or like dielectric molded materials.

As shown in FIG. 12, the top surface of the body 340 include two recessed areas 360. The bottom surface of the body 340 includes two additional recessed areas 360 (not visible in FIG. 12). One end of each recessed area 360 is connected by a passage such as a channel or an opening to the aperture 356 which receives the communication cable 60. The communications cable 60 includes eight insulated conductors 61-68 which are arranged as four differential pairs 71-74. The individual conductors that comprise each differential pair 71-74 (i.e., conductors 61/62, 63/66, 64/65 and 67/68) are twisted about each other, and all four differential pairs 71-74 are twisted about each other in a "core twist." The end of each of the conductors 61-68 is passed through a respective one of the above-mentioned passages that connect aperture 356 and each recessed area 360 into the rear portion 361 of each recessed area 360. This is more clearly illustrated in FIG. 14.

Each recessed area 360 further includes a twist terminator 366 that may be used to consistently set the location where the differential pairs 71-74 received within the respective recessed areas 360 switch from a twisted to an untwisted configuration. Here, the twist terminator 366 includes a pointed, or knife-like, ridge that may help a technician to separate the individual conductors 61-68 within each differential pair 71-74. Each recessed area 360 further includes a pair of channels, 364 that are separated by a vertical wall. As shown in FIG. 12, each differential pair 71-74 is routed into a respective one of the recesses 360. In the back portion of each recess 360 the differential pair 71-74 may remain twisted. A respective one of the twist terminators 366 is then used to separate the individual conductors 61-68 within each differential pair 71-74, and each separated conductor 61-68 is routed into a respective one of the channels 364. As shown best in FIG. 14, each channel 364 extends toward the forward edge of its respective shelf 346, 348 and then bends around the front edge of the shelf into the opening 349. A technician may insert the end of each conductor 61-68 into is respective channel 364 so that each conductor 61-68 likewise bends around the front edge of the shelf into the opening 349. When the rear edge of printed circuit board 320 is inserted into the opening 349 in board edge termination assembly 330, each output contact is aligned with a respective one of the conductors 61-68 that are seated in their respective slots 364. The sharp edge on each output contact cuts the insulation surrounding its respective conductor to make sound mechanical and electrical contact with the conductor.

The skilled artisan will recognize numerous modifications may be made to the above described communications jacks and board edge termination assemblies without departing from the spirit or scope of the present invention. For example, although the communications jacks illustrated and described herein are configured to communicate communication signals over four differential pairs (i.e., eight wires), communications jacks that are configured to accommodate other numbers of differential pairs may also be used. The skilled artisan will likewise recognize that the input contacts 111-118 can extend into the plug aperture 106 of the jack frame 104 from a variety of different directions, such as from the front of the jack, from the back of the jack, and from the bottom of the jack or the top of the jack. The skilled artisan will also recognize that the contact members 181-188 may have a variety of different configurations. For example, the spring contact portions **181*a*-188*a* may have different shapes or configurations, or may be replaced with other types of contact portions. Preferably, the contact portion used will have a good wiping action with respect to the contact pads 191-198 on printed circuit board 120 (in designs that include such contact pads) and/or will otherwise make a sound, low resistivity connection. The contact pads 191-198 may be located in different positions (i.e., on the rear edge of printed circuit board 120, in the middle of printed circuit board 120, all on the same side of printed circuit board 120, etc). It will also be appreciated that in some embodiments the contact pads 191-198** may be replaced with other types of contact such as, for example, wires or metal posts.

Further, those skilled in this art will recognize that the body of board edge termination assembly 130 may be modified in numerous ways. For example, the pivotable caps 150, 152 could be replaced with caps that are separate pieces that are not connected by hinges to body 140. In some embodiments, the caps 150, 152 could be omitted. As noted above, the shelves 146, 148 may take on numerous different configurations. The contact members may be located in different locations and/or connected in or to the body in a different manner. Thus, it will be appreciated that the foregoing description is illustrative of the present invention and is not to be construed as limiting thereof.

Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this ivneiotn as defined in the claims. The invention is defined by the following claims, with equivalents of the claims to be included therein.

The invention claimed is:

1. A communications jack, comprising:

a housing having a plug aperture;

a printed circuit board having first and second opposed sides, the first side of the printed circuit board including first through fourth output contacts and the second side of the printed circuit board including fifth through eighth output contacts;

first through eighth input contacts mounted on the printed circuit board and extending into the plug aperture;

a board edge termination assembly mounted on an edge of the printed circuit board, the board edge termination assembly comprising a body and first through eighth contact members that are completely received within the body;

wherein each of the first through eighth contact member is configured to mate with a respective one of the output contacts; and wherein each of the first through eighth contact members comprises a unitary element that includes a contact portion that is configured to mate with a respective one of the output contacts and an insulation displacement contact portion.

2. The communications jack of claim 1, wherein the board edge termination assembly is releasably attached to at least one of the housing or the printed circuit board.

3. The communications jack of claim 1, wherein each of the plurality of input contacts is a jackwire contact, wherein each of the plurality of output contacts is a contact pad, and wherein the spring contact portion of each of the contact members is configured to mate with a respective one of the contact pads.

4. The communications jack of claim 3, wherein the body of the board edge termination assembly includes an aperture that is configured to receive a jacketed communications cable that includes a plurality of differential pairs of conductors.

5. The communications jack of claim 4, wherein the body further includes a plurality of recesses, wherein one of the contact members is mounted in each recess.

6. The communications jack of claim 5, wherein the body further includes a plurality of passages, each of which extends between the aperture and a respective one of the recesses.

7. A communications jack, comprising:

a housing having a plug aperture;

a printed circuit board having first and second opposed sides, the first side of the printed circuit board including first through fourth output contacts and the second side of the printed circuit board including fifth through eighth output contacts;

first through eighth input contacts mounted on the printed circuit board and extending into the plug aperture;

a board edge termination assembly mounted on an edge of the printed circuit board, the board edge termination assembly comprising a body and first through eighth contact members that are disposed at least partly within the body;

wherein each of the first through eighth contact member is configured to mate with a respective one of the output contacts; and wherein the board edge termination assembly includes a first pivotable cap.

8. The communications jack of claim 7, wherein the board edge termination assembly further includes a second pivotable cap, wherein the first pivotable cap is connected to the body by a first hinge and the second pivotable cap is connected to the body by a second hinge.

9. A communications jack, comprising:

a housing having a plug aperture;

a printed circuit board having first and second opposed sides, the first side of the printed circuit board including first through fourth output contacts and the second side of the printed circuit board including fifth through eighth output contacts;

first through eighth input contacts mounted on the printed circuit board and extending into the plug aperture;

a board edge termination assembly mounted on an edge of the printed circuit board, the board edge termination assembly comprising a body and first through eighth contact members that are disposed at least partly within the body;

wherein each of the first through eighth contact member is configured to mate with a respective one of the output contacts;

wherein each of the plurality of input contacts is a jackwire contact, wherein each of the plurality of output contacts is a contact pad, wherein each of the contact members includes a wire connection terminal portion and a spring contact portion, and wherein the spring contact portion of each of the contact members is configured to mate with a respective one of the contact pads; and wherein the body of the board edge termination assembly includes an aperture that is configured to receive a jacketed communications cable that includes a plurality of differential pairs of conductors;

wherein the body comprises a cable receiving end that includes the aperture and a board mounting end that includes first and second shelves that at least partially define an opening therebetween that receives the edge of the printed circuit board.

10. The communications jack of claim 9, wherein an interior surface of each of the first and second shelves includes a plurality of slots, and wherein the spring contact portion of a respective one of the contact members extends through each of the plurality of slots.

11. The communications jack of claim 10, wherein the first through fourth contact members are mounted at least partly within the first shelf, and the fifth through eighth contact members are mounted at least partly within the second shelf.

12. A communications jack, comprising:

a housing having a plug aperture;

a printed circuit board having first and second opposed sides, the first side of the printed circuit board including first through fourth output contacts and the second side of the printed circuit board including fifth through eighth output contacts;

first through eighth input contacts mounted on the printed circuit board and extending into the plug aperture;

a board edge termination assembly mounted on an edge of the printed circuit board, the board edge termination assembly comprising a body and first through eighth contact members that are disposed at least partly within the body;

wherein each of the first through eighth contact member is configured to mate with a respective one of the output contacts;

wherein each of the plurality of input contacts is a jackwire contact, wherein each of the plurality of output contacts is a contact pad, wherein each of the contact members includes a wire connection terminal portion and a spring contact portion, and wherein the spring contact portion of each of the contact members is configured to mate with a respective one of the contact pads;

wherein the body of the board edge termination assembly includes an aperture that is configured to receive a jacketed communications cable that includes a plurality of differential pairs of conductors; and wherein the body further includes a plurality of recesses, wherein one of the contact members is mounted in each recess; and further comprising a plurality of twist terminators that are provided in respective of the plurality of recesses.

13. A communications jack, comprising:

a printed circuit board that includes a plurality of contact pads;

a plurality of jackwire contacts mounted on the printed circuit board;

a housing having a plug aperture, wherein the plurality of jackwire contacts extend into the plug aperture;

a board edge termination assembly mounted on an edge of the printed circuit board, the board edge termination assembly comprising a body and a plurality of unitary contact members, each of the contact members including an insulation displacement contact portion and a spring contact portion that is configured to mate with a respective one of the contact pads, the board edge termination assembly further including a cable receiving aperture that is configured to receive a jacketed communications cable that includes a plurality of differential pairs of conductors, wherein the spring contact portion of each contact member extends through a respective slot in the body of the board edge termination assembly.

14. The communications jack of claim 13, wherein some of the plurality of contact pads are located on an upper surface of the printed circuit board, and others of the plurality of contact pads are located on a lower surface of the printed circuit board.

15. A communications jack, comprising:

a printed circuit board that includes a plurality of contact pads;

a plurality of jackwire contacts mounted on the printed circuit board;

a housing having a plug apertures, wherein the plurality of jackwire contacts extend into the plug aperture;

a board edge termination assembly mounted on an edge of the printed circuit board, the board edge termination assembly comprising a body and a plurality of contact members, each of the contact members including a wire connection terminal portion and a spring contact portion that is configured to mate with a respective one of the contact pads, the board edge termination assembly further including a cable receiving aperture that is configured to receive a jacketed communications cable that includes a plurality of differential pairs of conductors;

wherein the board edge termination assembly includes a first pivotable cap and a second pivotable cap, wherein the first pivotable cap is connected to the body by a first hinge and the second pivotable cap is connected to the body by a second hinge.

16. A communications jack, comprising:

a printed circuit board that includes a plurality of contact pads;

a plurality of jackwire contacts mounted on the printed circuit board;

a housing having a plug aperture, wherein the plurality of jackwire contacts extend into the plug aperture;

a board edge termination assembly mounted on an edge of the printed circuit board, the board edge termination assembly comprising a body and a plurality of contact members, each of the contact members including a wire connection terminal portion and a spring contact portion that is configured to mate with a respective one of the contact pads, the board edge termination assembly further including a cable receiving aperture that is configured to receive a jacketed communications cable that includes a plurality of differential pairs of conductors;

wherein the body comprises a cable receiving end that includes the aperture and a board mounting end that includes first and second shelves that at least partially define an opening therebetween that receives the edge of the printed circuit board.

17. The communications jack of claim 16, wherein an interior surface of each of the first and second shelves includes a plurality of slots, and wherein the spring contact portion of a respective one of the contact members extends through each of the plurality of slots.

18. A board edge termination assembly that is configured to mate with a communications jack that includes a printed circuit board having a plurality of contact pads thereon, the board edge termination assembly comprising:

a body having an aperture that is configured to receive a communications cable that includes a plurality of differential pairs of conductors, the body including first and second shelves that at least partially define an opening therebetween that is configured to receive an edge of the printed circuit board of the communications jack; and a plurality of contact members disposed at least partly within the body, wherein some of the contact members are mounted in the first shelf and other of the contact members are mounted in the second shelf, each of the contact members including a wire connection terminal portion that is configured to connect with a respective one of the conductors of the communications cable and a spring contact portion that is configured to make electrical contact with a respective one of the contact pads on the printed circuit board.

19. The board edge termination assembly of claim 18, further comprising a first pivotable cap and a second pivotable cap, wherein the first pivotable cap is connected to the body by a first hinge and the second pivotable cap is connected to the body by a second hinge.

20. The board edge termination assembly of claim 18, wherein the spring contact portions of some of the plurality of contact members extend through respective slots in the first shelf, and wherein the spring contact portions of others of the plurality of contact members extend through respective slots in the second shelf.

21. The board edge termination assembly of claim 20, wherein the slots in the first shelf face the second shelf and the slots in the second shelf face the first shelf.

22. A communications jack, comprising:

a housing having a plug aperture;

a printed circuit board that is mounted at least partly within the housing;

a plurality of insulation piercing output contacts on the printed circuit board;

a plurality of jackwire contacts mounted on the printed circuit board to extend into the plug aperture;

a board edge termination assembly mounted on an edge of the printed circuit board, the board edge termination assembly comprising:

a body that includes a cable receiving aperture that is configured to receive a communications cable that includes a plurality of pairs of conductors; and a plurality of channels that each receive a respective one of the conductors, wherein each channel is aligned with a respective one of the insulation piercing output contacts so that each he insulation piercing output contact pierces the insulation on its respective conductor when the board edge termination assembly is mounted in the printed circuit board.

* * * * *

UNITED STATES PATENT AND TRADEMARK OFFICE

CERTIFICATE OF CORRECTION

PATENT NO. : 7,503,810 B1
APPLICATION NO. : 11/854063
DATED : March 17, 2009
INVENTOR(S) : Goodrich et al.

It is certified that error appears in the above-identified patent and that said Letters Patent is hereby corrected as shown below:

In the Claims:

Column 21, Claim 15, Line 15: Please correct "apertures" to read -- aperture --

Column 22, Claim 22, Line 53: Please correct "each he insulation"
to read -- each insulation --

Signed and Sealed this

Twelfth Day of May, 2009

JOHN DOLL
*Acting Director of the United States Patent and Trademark Office*